United States Patent [19]

Kautz et al.

[11] Patent Number: 4,754,636

[45] Date of Patent: Jul. 5, 1988

[54] CONNECTOR LOCATING DEVICE FOR CRIMPING TOOLS

[75] Inventors: Jon F. Kautz, Camp Hill; Howard W. Rose, Boiling Springs, both of Pa.

[73] Assignee: AMP Incorporated, Harrisburg, Pa.

[21] Appl. No.: 60,191

[22] Filed: Jun. 10, 1987

Related U.S. Application Data

[63] Continuation of Ser. No. 736,178, May 20, 1985, abandoned.

[51] Int. Cl.[4] ..... B21D 39/00

[52] U.S. Cl. ..... 72/410; 29/751; 29/758; 81/421

[58] Field of Search ..... 72/409, 410, 461; 29/747, 748, 749, 750, 751, 753, 758; 81/421

[56] References Cited

U.S. PATENT DOCUMENTS

| | | | |
|---|---|---|---|
| 2,086,400 | 7/1937 | Brenizer | 72/410 |
| 2,359,083 | 9/1944 | Carlson | 72/410 |
| 3,109,333 | 11/1963 | Anderson | 72/410 |
| 3,281,926 | 11/1966 | Frastaci et al. | 72/410 |
| 3,417,599 | 12/1968 | Burns | 72/410 |
| 3,523,351 | 9/1970 | Filia | 72/410 |
| 3,571,890 | 3/1971 | Brehm | 72/410 |
| 3,611,782 | 10/1971 | Eppler | 72/410 |

*Primary Examiner*—David Jones

*Attorney, Agent, or Firm*—Allan B. Osborne

[57] ABSTRACT

A locating device for crimping tools adapted to hold a connector firmly between crimping die sets and a wire guide for guiding a wire into the connector located between the crimping die sets.

1 Claim, 6 Drawing Sheets

CONNECTOR LOCATING DEVICE FOR CRIMPING TOOLS

This is a continuation of application Ser. No. 736,178 filed May 20, 1985, now abandoned.

It is the practice in using hand crimping tools to insert a connector in between the jaws or dies and locate the connector by closing the dies partially thereonto. A wire with the insulation stripped from an end is then inserted into the ferrule portion of the connector and the dies tightly closed to crimp the ferrule portion around the wire. A ratchet mechanism is employed in most such tools to insure that the proper crimping pressure is applied. However, a drawback to such mechanism is that once the ratcheting begins, it cannot be reversed until a predetermined crimping pressure has been reached. Accordingly, if the connector is not positioned correctly, the dies nevertheless must be closed before the connector can be removed, and in closing the dies, the ferrule is crimped and the connector ruined.

Another problem with partially closing the dies to hold the connector is that the dies obstruct the view of the connector, making wire insertion difficult. This is particularly true where the connector is for coaxial cable and includes two ferrules, one for the signal wire and the second for a braid covered dielectric. The signal wire ferrule is in front of the second, much larger braided dielectric ferrule. Thus, with the dies partially closed, it becomes very difficult to thread the small signal wire into the first ferrule. Often the wire is bent and not properly located in the ferrule. Without being able to see, the operator crimps the connector only to discover the mistake after it is too late to correct it.

It is the object of the present invention to provide a connector locating device, mounted on a crimping tool, for use with a coaxial type connector.

A connector locating device of the present invention includes a blade which extends down in front of the opening in the crimping tool into which the connector is positioned. The blade frictionally fits into a slot on one end of the connector to hold it firmly in position in the crimping tool. Further, the locating device of the present invention includes an L-shaped wire guide mounted adjacent the opening into which the wire is inserted. The wire guide directs the wire into proper location with respect to the ferrules on the connector positioned within.

For a better understanding of the invention, a detailed description thereof follows with references being made to the accompanying drawings in which.

Figure 1:
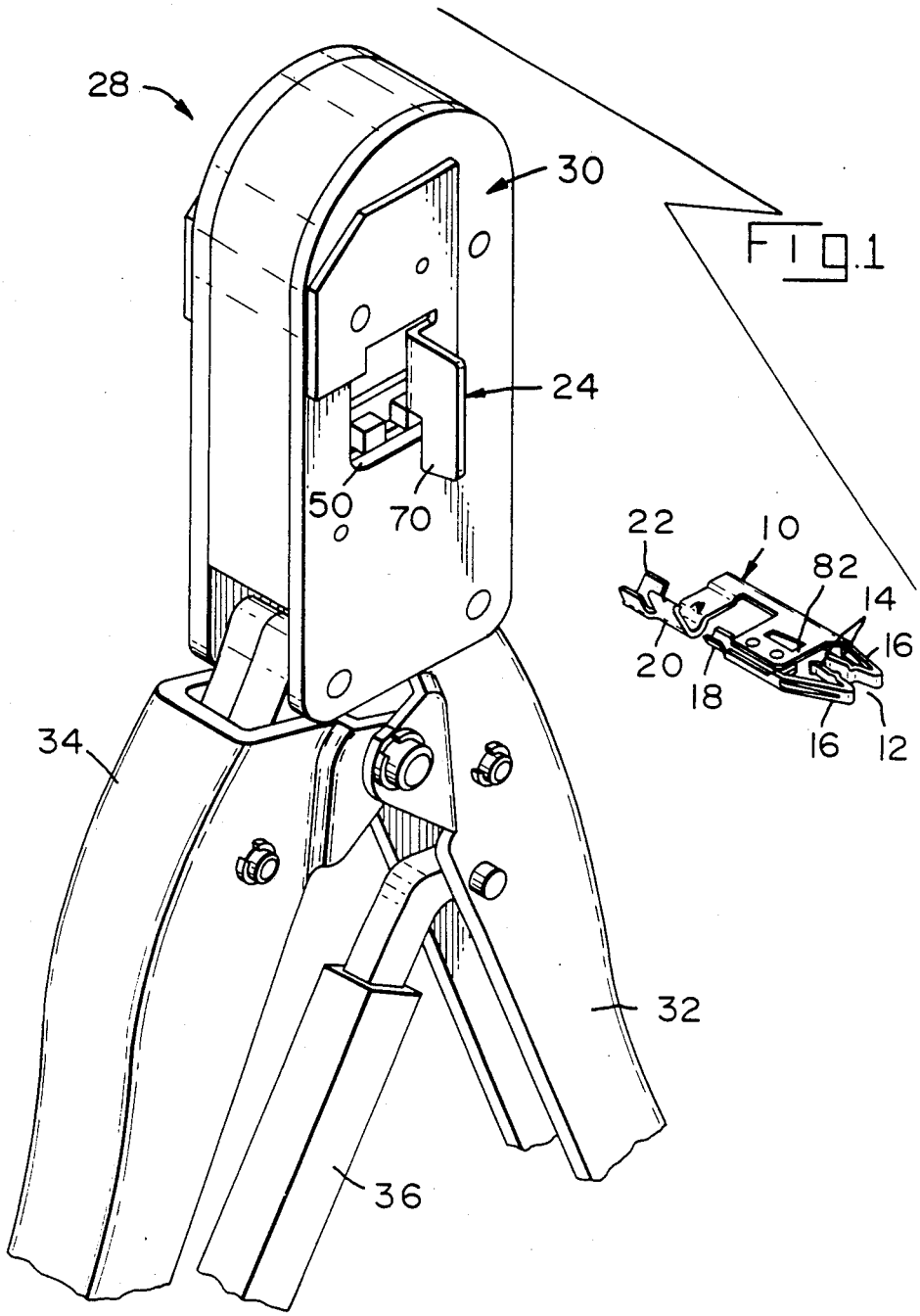
FIG. 1 is an isometric view of a straight action crimping hand tool on which the connector locating device of the present invention is mounted.

The connector locating device of the present invention was specifically designed to work with connectors having a slot at one end. One such connector is shown in FIGS. 1 and 3–8 and is indicated by reference numeral 10. Slot 12, located at the front of connector 10, is defined by reversely bent free ends 14 of spring arms 16. Connector 10, sold by AMP incorporated of Harrisburg, Pa. under the trademark AMP-TAB electrical connector, is for coaxial cable and includes signal wire ferrule 18, braid ferrule 20 and insulation support ferrule 22.

The connector locating device of the present invention includes locator 24, FIGS. 1 through 6 and wire guide 26, FIGS. 2 through 6.

Locator 24 and guide 26 are illustrated in conjunction with straight action crimping hand tool 28. As will be apparent, locator 24 and guide 26 can be used with other type crimping tools.

Tool 28 includes crimping head 30 on which locator 24 and guide 26 are mounted. Tool 28 also includes handles 32, 34 and ratcheting mechanism 36.

Figure 2:
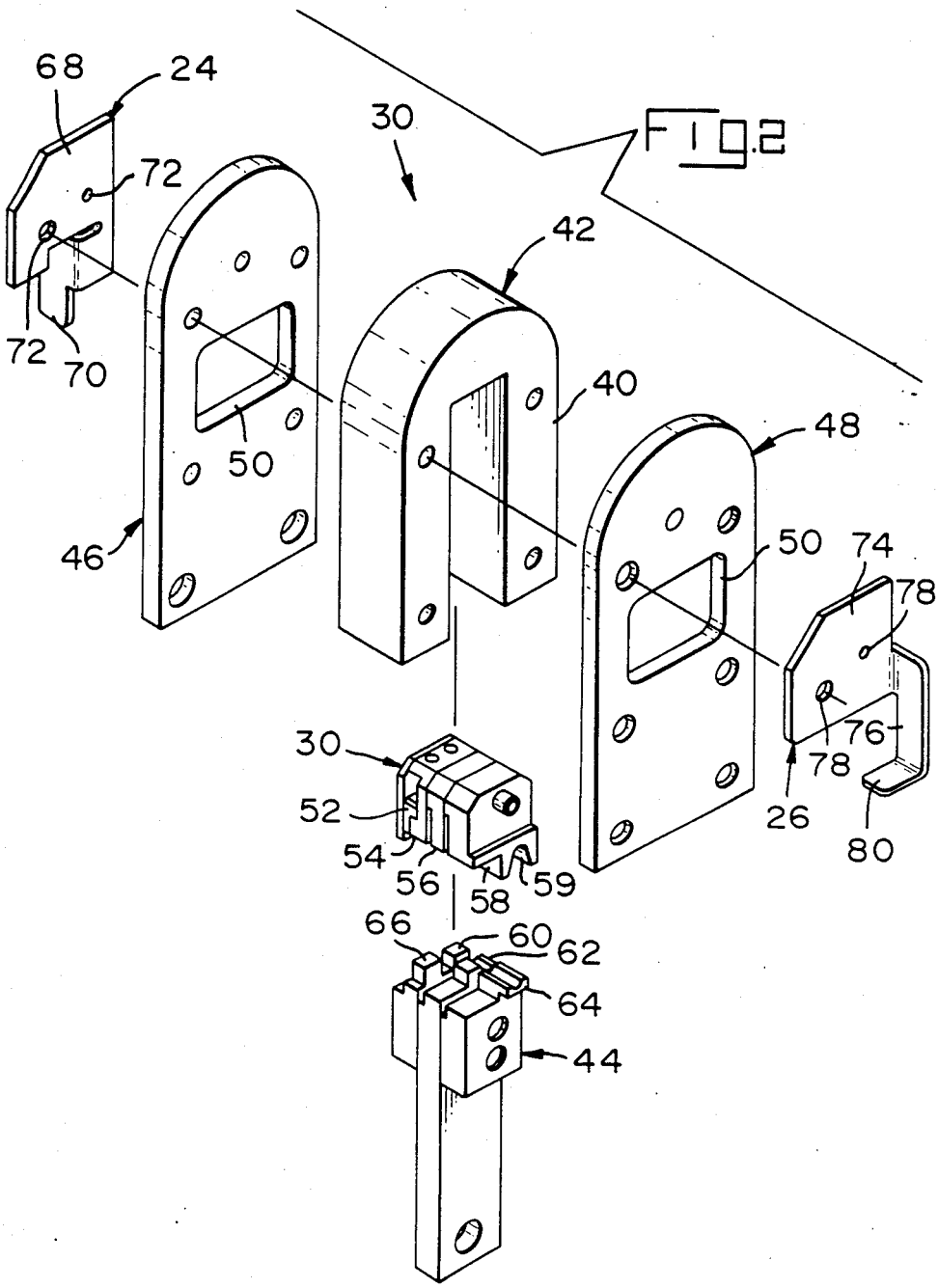
FIG. 2 is an isometric view of the several crimping components of the tool of FIG. 1.

The components of crimping head 30 are shown in exploded fashion in FIG. 2. FIGS. 2–8 show tool 28 in a reverse orientation relative to FIG. 1. This orientation provides a clearer view of the tool components and the use thereof in conjunction with the present invention. An upper die set 38 is secured between arms 40 of U-shaped member 42. Lower die set 44, fixed to a ram (not shown) at its lower end, moves towards and away from upper die set 38 to crimp connector 10. Front and rear plates 46,48 respectively, each having an opening 50 therethrough, are riveted to the sides of member 42.

Upper die set 38 includes a spring loaded wire stop 52, signal wire nest block 54, braid nest block 56 and insulation nest block 58. The nests on blocks 54 and 56 which cannot be seen, are conventional crimping nests such as the insulation nest 59 on block 58 which is visible.

Lower die set 44 includes signal wire anvil 60, braid anvil 62 and insulation anvil 64. Further included is support post 66.

Locator 24 includes a securing plate 68 and, at a right angle to plate 68, blade 70. Plate 68 includes mounting holes 72. Blade 70 has a determined thickness slightly greater than the width of slot 12 on connector 10 at its narrowest point.

Locator 24 is mounted onto front plate 46 by conventional fastening means; e.g., rivets (not shown) with plate 68 flush thereagainst so that blade 70 is perpendicular to plate 46. Locator 24 is positioned so that blade 70 extends down in front of opening 50 in plate 46 and is an equidistant between the two vertical sides of opening 50. FIG. 1 shows this positioning of locator 24.

Figure 3:
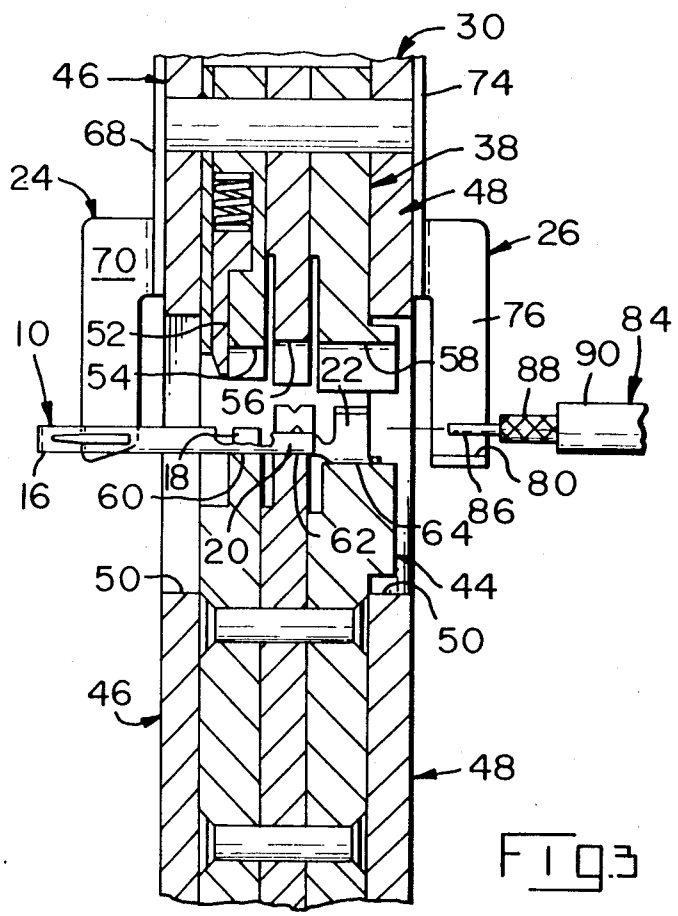
FIG. 3 is a side elevation, cross-sectional view of the assembled crimping components in the tool and with a connector positioned therein.

Wire guide 26 includes a securing plate 74 and, at right angles thereto, an L-shaped guide member 76. Mounting holes 78 are provided in plate 74 for mounting wire guide 26 to rear plate 48 such that horizontal portion 80 of the L-shaped guide member 76 is at the same level or place as the insulation support ferrule 22 when the connector 10 is positioned on lower die set 44. FIG. 3 shows this alignment.

FIG. 3 is a cross-sectional view of crimping head 30 showing upper die set 38, lower die set 44, locator 24 and wire guide 26. Further, the view shows connector 10 positioned within the crimping head 30, resting on top of lower die set 44; i.e., signal wire ferrule 18 on top of anvil 60, braid ferrule 30 on anvil 62, insulation support ferrule 22 on anvil 64 and a portion of the connector 10 resting on support post 66.

Figure 4:
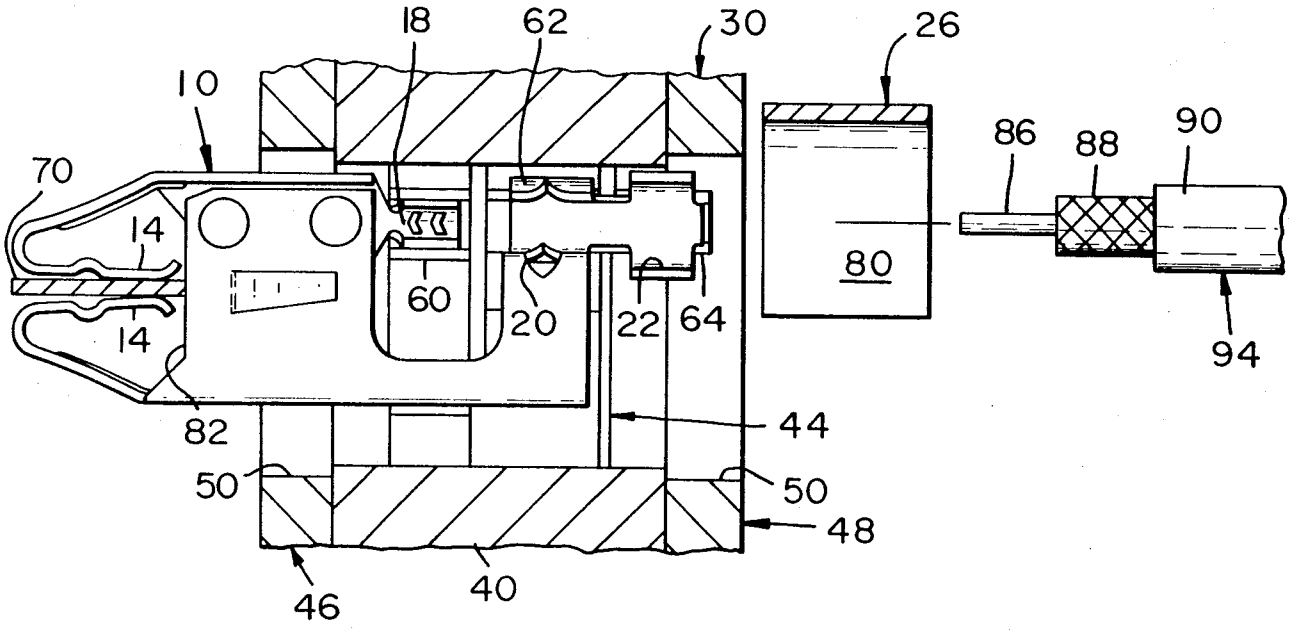
FIG. 4 is a view, partly in section, looking down towards the lower die set and a connector positioned thereon.

With reference to FIG. 1, connector 10 is positioned within crimping head 30 by angling the insulation support ferrule 22 first into the opening between the two die sets and then pivoting the connector 10 up to locate blade 70 in slot 12 between free ends 14 of spring arms 16. The compressive forces exerted on the blade 70 by the free ends 14 are quite sufficient to hold the connector 10 in place. With reference to FIG. 4, connector 10 is moved forward until blade 70 abuts edge 82 of connector 10 for correct positioning. Due to the location of blade 70, each of the three ferrules 18, 20 and 22 on connector 10 are properly located on anvils 60, 62 and 64 respectively.

With reference to both FIGS. 3 and 4, coaxial cable 84 is shown after being prepared for insertion into crimping head 30. Cable 84 includes signal wire 86, braid covered dielectric 88 and insulation jacket 90.

Coaxial cable 84 is guided into the space between the upper die set 38 and connector 10 by sliding along horizontal portion 80 of wire guide 26. With the visibility provided by the open or spaced apart die sets 38, 44 and the presence of wire guide 26, signal wire 86, braid covered dielectric 88 and insulation jacket 90 are easily and correctly positioned in ferrules 18, 20 and 22 respectively of connector 10. The positioning of cable 84 is further aided by connector 10 being stably held by cooperation between spring arms 16 and blade 70.

Figure 5:
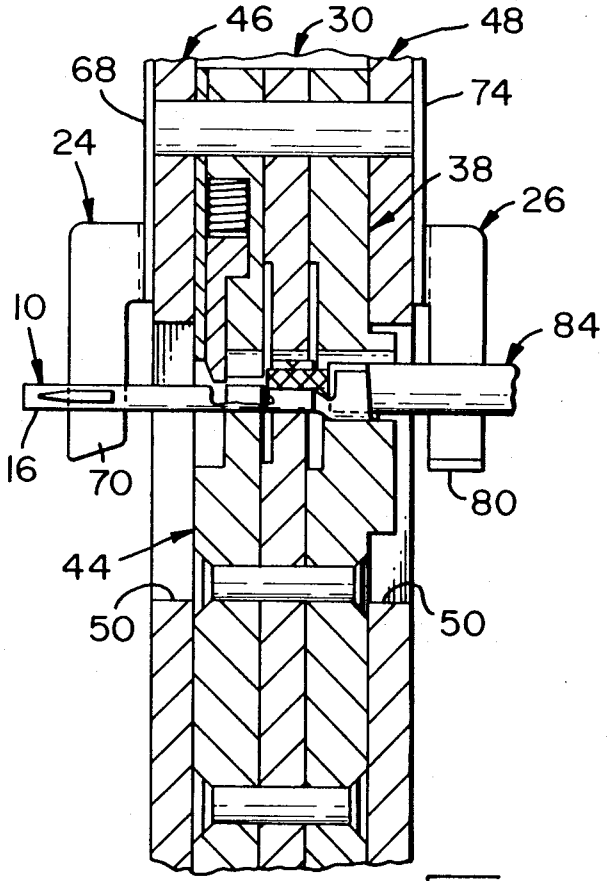
FIG. 5 is the same view as FIG. 3 with a wire positioned in the connector preparatory to being crimped thereinto.

FIG. 5 is a side elevation, cross-sectional view, similar to FIG. 3, but with the lower die set 44 advancing towards upper die set 38. This view shows connector 10 being carried along by lower die set 44 with blade 70 on locator 24 acting to keep connector 10 properly orientated until crimping takes place. Also, coaxial cable 84 is guided by being held against guide member 76 on wire guide 26.

Figure 6:
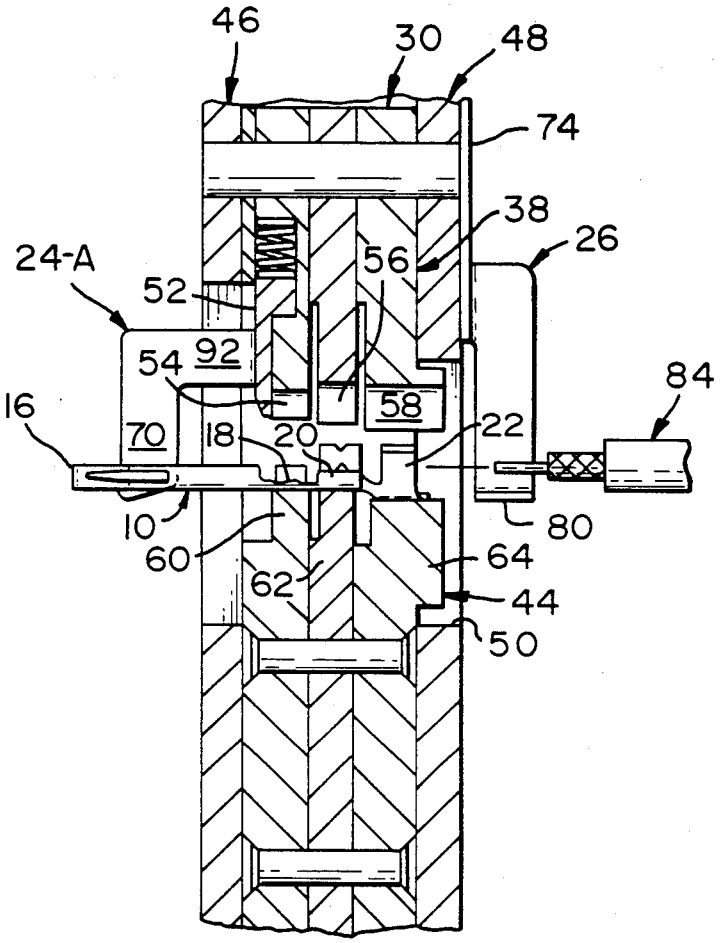
FIG. 6 is the same view as FIGS. 3 and 5 illustrating another method of mounting the connector locating device on the tool.

FIG. 6 is a view similar to FIG. 3 but where locator 24 has been modified. The modified locator, indicated generally by reference numeral 24-A, includes blade 70 and arm 92 which is at right angles to blade 70 and which is attached to wire stop 52 of upper die set 38.

Figure 8:
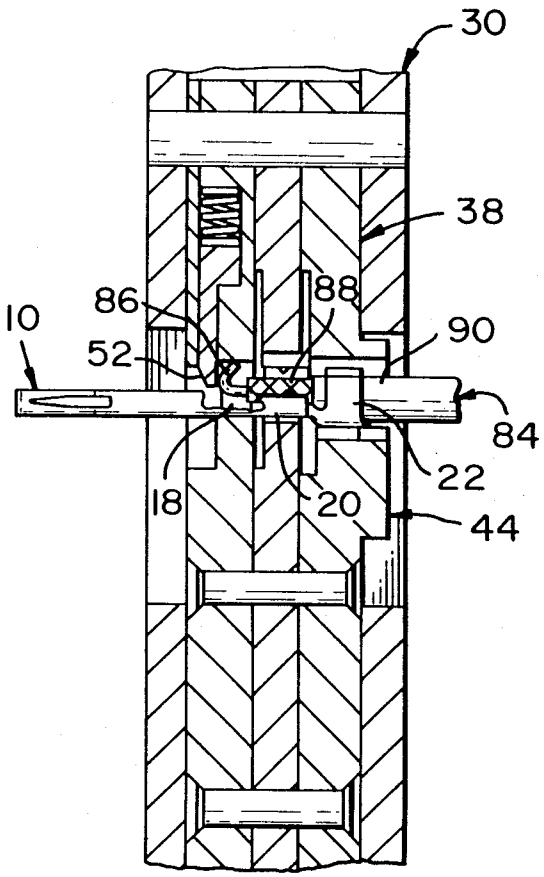
FIGS. 7 and 8 are views similar to FIG. 3 but without the connector locating device on the tool so as to illustrate the problems experienced in crimping a connector without the locating device.
Figure 7:
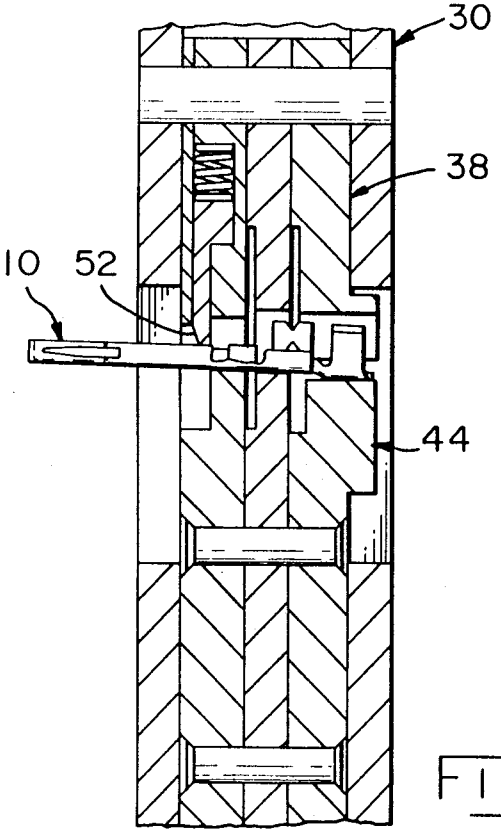

FIGS. 7 and 8 illustrate common problems experienced in terminating cable 84 in connector 10 absent the locator 24 and wire guide 26 of the present invention. In FIG. 7, connector 10 was placed incorrectly on lower die set 44. The operator advanced the lower die set 44 only to discover the error after it was too late to correct. He must continue to complete the crimping action in order to remove the connector 10 which would be damaged beyond repair.

FIG. 8 illustrates a more common problem. The operator placed connector 10 correctly on the lower die set 44 and advanced it towards upper die set 38 to where the connector 10 is held firmly therebetween but before any ferrule crimping takes place. The operator then inserted cable 84 in between upper die set 38 and connector 10 to locate signal wire 86 in ferrule 18, braid covered dielectric 88 in ferrule 20 and insulation jacket 90 in ferrule 22. Unfortunately, not being able to see into the now reduced space between connector 10 and upper die set 38, signal wire 86 was pushed into wire stop 52 too hard with the result shown; i.e., it was bent back. Here again, because of the difficulty in seeing, the operator would probably not be aware of the problem and he would complete the crimp, only to have to cut the connector 10 from cable 84 and discard it. If he was aware of the problem, he would withdraw the cable 84, straighten out signal wire 86 and reinsert it.

We claim:

1. A connector retaining device for use in crimping connectors having a forwardly projecting slotted mating end with the slot open at the front end, said device being crimped in a crimping tool having movable crimping dies within both sides of a frame, said device comprising a plate mounted on a first side of the frame and a blade having a predetermined thickness attached to said plate and extending away from a surface of said plate to be positioned in front of and outside a first opening in the frame with the width of said blade being perpendicular to a plane of a surface of said first side of the frame and with the thickness of said blade being parallel to the plane of said first surface of the frame so that upon inserting the connector into the tool through a second opening, the forwardly projecting, slotted mating end of the connector extends through said first opening and said slotted mating end frictionally engages the blade so that the connector is steadily retained in the tool for crimping thereof, and further including a wire guide comprising a plate mounted on a second side of the frame having therethrough said second opening, and an L-shaped member attached to said plate and positioned to extend along two adjacent sides of said second opening to receive, support and guide a wire into said second opening for insertion into a wire receiving ferrule on the connector.

* * * * *